US007478737B2

(12) United States Patent
Gosi et al.

(10) Patent No.: US 7,478,737 B2
(45) Date of Patent: Jan. 20, 2009

(54) BEVERAGE DISPENSER

(76) Inventors: Riccardo Gosi, Via XX Luglio 47, 50020 Panzano in Chianti (IT); Guido Torri, Via Palombara 36, 47853 Coriano (IT); Marco Degl'Innocenti, Via Caponsacchi 48, 50126 Florence (IT); Lorenzo Bencista', Viale Rosa Libri 42, 50022 Greve in Chianti (IT)

( * ) Notice: Subject to any disclaimer, the term of this patent is extended or adjusted under 35 U.S.C. 154(b) by 349 days.

(21) Appl. No.: 10/511,590

(22) PCT Filed: Apr. 9, 2003

(86) PCT No.: PCT/EP03/03671

§ 371 (c)(1),
(2), (4) Date: Oct. 12, 2004

(87) PCT Pub. No.: WO03/084860

PCT Pub. Date: Oct. 16, 2003

(65) Prior Publication Data

US 2005/0150549 A1 Jul. 14, 2005

(30) Foreign Application Priority Data

Apr. 10, 2002 (EP) ..... 02007998

(51) Int. Cl.
*B67D 1/04* (2006.01)

(52) U.S. Cl. ..... 222/148; 222/152; 222/400.7; 141/90

(58) Field of Classification Search ..... 222/400.7, 222/129–129.4, 152, 394, 399, 23, 25–28, 222/30, 36–39, 1, 148; 251/129.01, 129.04, 251/129.15, 129.16; 141/89–91
See application file for complete search history.

(56) References Cited

U.S. PATENT DOCUMENTS

| | | | | |
|---|---|---|---|---|
| 4,350,187 | A * | 9/1982 | Trusselle et al. | 141/90 |
| 5,031,799 | A * | 7/1991 | Owen | 222/131 |
| 5,163,584 | A * | 11/1992 | Huber et al. | 222/1 |
| 5,507,411 | A | 4/1996 | Peckels | |
| 5,524,683 | A * | 6/1996 | Mueller | 141/129 |
| 5,913,454 | A * | 6/1999 | McHale | 222/2 |
| 6,715,641 | B2 * | 4/2004 | Torimitsu et al. | 222/63 |

FOREIGN PATENT DOCUMENTS

| | | | |
|---|---|---|---|
| DE | 9300928 | U | 3/1993 |
| DE | 9307040 | U | 7/1993 |
| DE | 19948471 | A | 4/2001 |
| FR | 2616767 | A | 12/1998 |

OTHER PUBLICATIONS

International Search Report of PCT/EP2003/03671, corresponding to the present application, dated Jul. 7, 2003.

* cited by examiner

*Primary Examiner*—J. Casimer Jacyna

(57) ABSTRACT

An apparatus allowing the automatic drawing out of beverages from bottles (wherein the bottles are kept in their vertical position) comprising a drawing tap (12) which permits the entering of the gas in the bottle, the drawing of the liquid and the cleaning of the spout channel (19) and allows an easy and hygienic substitution of the empty bottles.

11 Claims, 3 Drawing Sheets

BEVERAGE DISPENSER

FIELD OF THE INVENTION

The invention refers to an apparatus for the automatic drawing out of beverages from bottles wherein the bottles are kept in their normal vertical position.

STATE OF THE ART

Apparatuses for the automatic drawing out of beverages, in particular bottled beverages, are well known and widely employed. Some of them, wherein the bottles are upside down, allow the drawing by opening a suitable valve which allows the falling by gravity of the liquid, others allow the drawing from bottles kept in their normal vertical position by way of two pipes passing through the bottle cork, an inert gas is injected into the bottle through one the above said pipe, so maintaining the bottled liquid under pressure; when the corresponding drawing tap for drawing the liquid is open, the gas under pressure pushes the liquid through the second pipe.

The second method is particularly suitable for those beverages which would suffer from the upside down position of the bottles, for example wines.

However, the apparatuses known up to now present various drawbacks. In fact, they do not allow a complete drawing of the liquid since some drops always remain in the channels or in the drawing tap and, when dried, leave a deposit which goes bad under the action of the air and can pollute the subsequent draught; the liquid while stopping in the pipes can change its taste, moreover the substitution of the empty bottles is rather complicated and it is always possible that the pipes come into contact with the surface on which the bottles rest, collecting bacteria or other pollutants which can alter the taste of the liquid.

SUMMARY OF THE INVENTION

The present invention refers to an apparatus for the automatic drawing out of liquids from bottles, wherein the bottles are kept in their normal vertical position, comprising a drawing tap, equipped with an electric valve. In the body of such drawing tap suitable channels are present which allow the entry of the inert pushing gas, the drawing of the liquid and the cleaning of the drawing tap after the drawing.

DETAILED DESCRIPTION OF THE INVENTION

Figure 1:
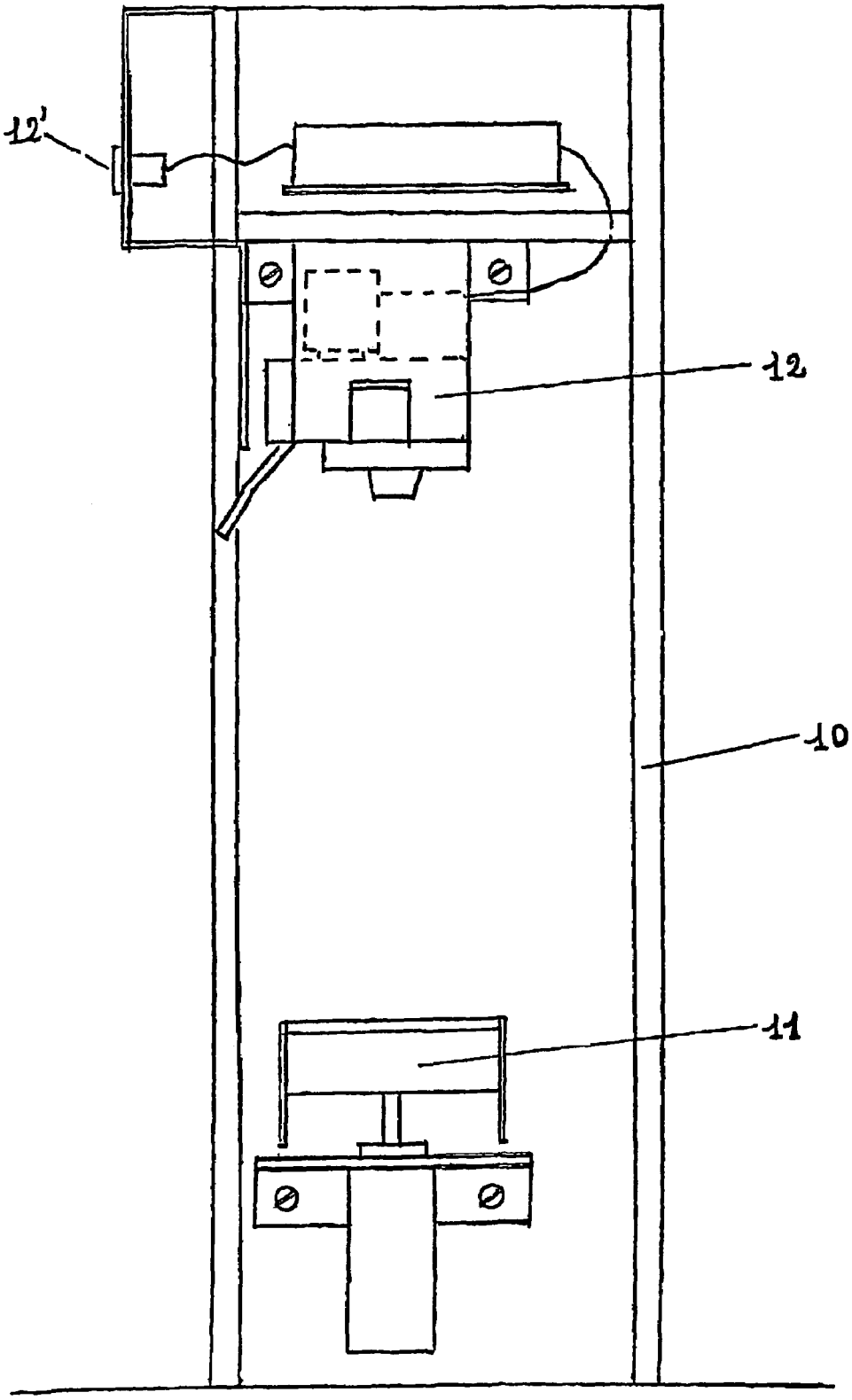
FIG. 1 schematically shows a section of an apparatus according to the invention.

The present invention overcomes the above said drawbacks by means of an apparatus wherein the bottle is placed vertically on a lifting means and which has a drawing tap permitting the entry of the inert gas, the exit of the liquid and the cleaning of the drawing tap.

As it is shown in FIG. 1 the apparatus has a body 10, on the interior surface of which is present a lifting means 11.

In the upper part of the body 10, above the lifting means 11, is placed the drawing tap 12 which is connected to a suitable switch 12' and to the gas and electric circuits (not shown in the figure).

Figure 2:
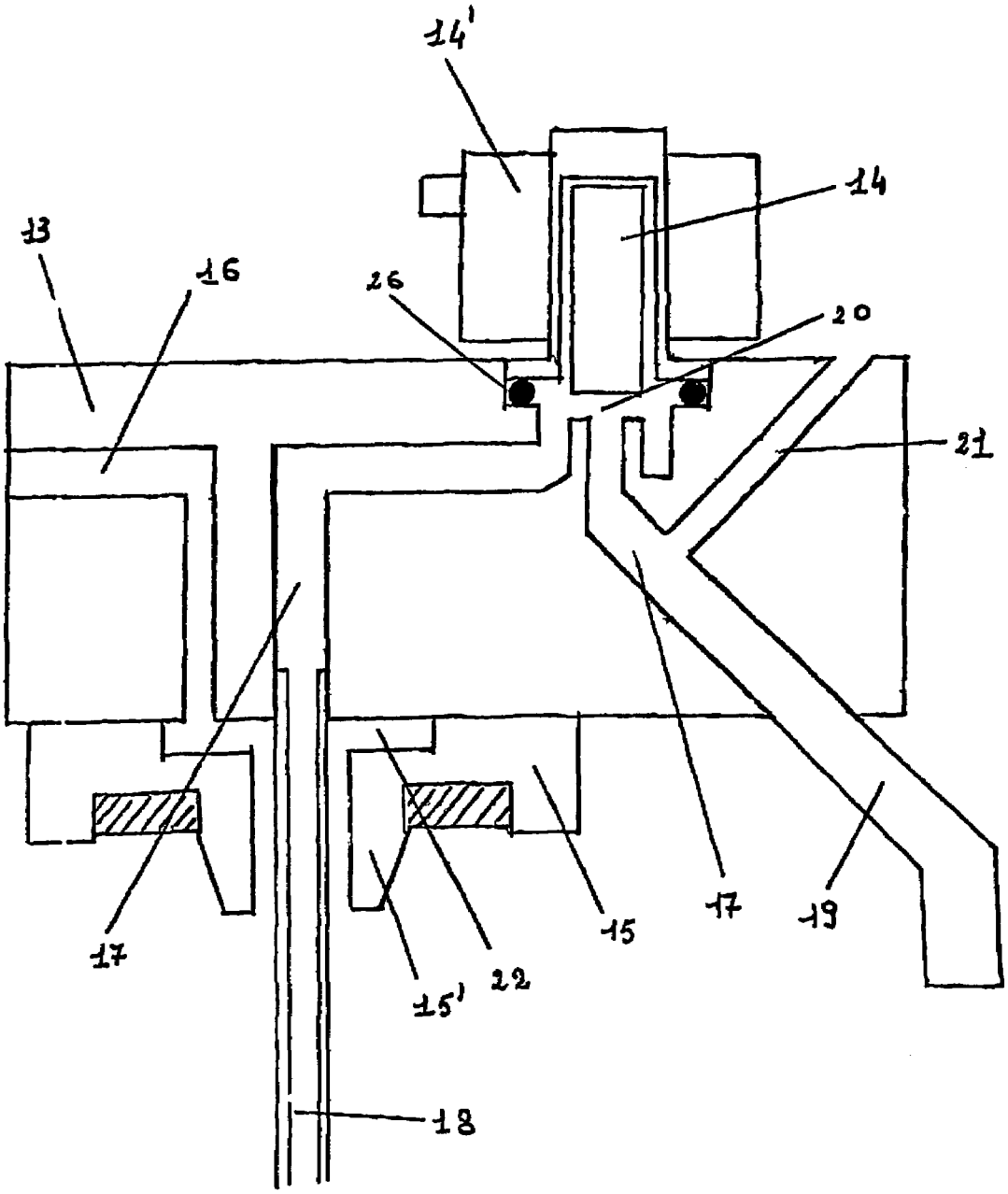
FIG. 2 represent, in detail, a section of the drawing tap.

As shown in FIG. 2 the drawing tap 12 consists of a body 13, an electric valve 14 (and the corresponding magnet 14') and a tap 15 which can engage with the bottle neck through its conical mouth 15'.

The electric valve 14 is, preferably, a diaphragm electric valve.

Inside the body 13 of the drawing tap 12 are present:

- a channel 16 permitting the entry into the bottle of the inert gas (connected to the pipe of the gas circuit not shown in the figure);
- a channel 17 into which flows the drawn liquid, connected on one side to the pipe 18 and to the opposite side to the spout 19.

The channel 17 enters a chamber 20 closed by the piston of the electric valve 14 and a branch 21 which is also connected to the inert gas circuit (not shown in the figure).

The tap 15 can be solidly connected to the body 13 through a chamber 22 or, according to a preferred method of the invention, can be free to move up and down in such chamber 22, in this case a spring 23 is present in the chamber 22 and pushes the tap 15 downwards.

On the external part of the tap 15 a gasket 24 (normally a rubber ring) is present. According to this second preferred method, the channel 16 at the end which enters into chamber 22 is closed by a needle valve 25. In this case, as it can be seen from FIG. 3, the tap 15, when moving upwards will act on such needle valve 25, allowing the automatic entry of the gas from channel 16 into the bottle.

Through the mouth 15' of the tap 15 passes the pipe 18 (preferably in flexible material) which is connected to the channel 17 and through which the liquid flows from the bottle to the spout 19.

The lifting means 11 can be moved manually, mechanically, electrically or pneumatically (possibly connected to the inert gas circuit) and will lift the bottle until the bottle neck enters the conic mouth 15' of the tap 15 and adheres to the gasket 24.

The upper surface of the lifting means is preferably made of, or covered with, anti-slipping materials.

Suitable gaskets 26 (for example O-Rings) assure the seal of the electric valve and the tap 15 (when in the moving version).

The apparatus obviously comprises the necessary hydraulic and electric circuits, and the inert gas tank, used for the apparatuses already known in the art for the same purposes. The hydraulic circuit connects the gas tank to the drawing tap and possibly to the lifting mechanism of the lifting means 11, and comprises the suitable means (valves, regulators etc.) for controlling and stabilising the gas pressure to the required predetermined values, while the electric circuit will activate the electric parts of the apparatus (switches, electric valve etc).

According to a particular embodiment of the invention the means regulating hydraulic and electric functions (pressure, switching on/off, drawing times, etc.) can be controlled by a suitable software, which can possibly be activated by the user through a personalised magnetic or chip card allowing also the automatic debiting of the draught.

According to a further particular embodiment of the invention, a liquid crystal- or a luminous led- display showing the amount due for each draught can be present on the body of the apparatus by each bottle.

The functioning of the apparatus according to the invention is extremely simple.

The pipe 18 is placed into the bottle and the bottle is placed on the lifting means 11.

Acting on the lifting means 11 the bottle is lifted until the top of the neck adheres to the gasket 24.

Figure 3:
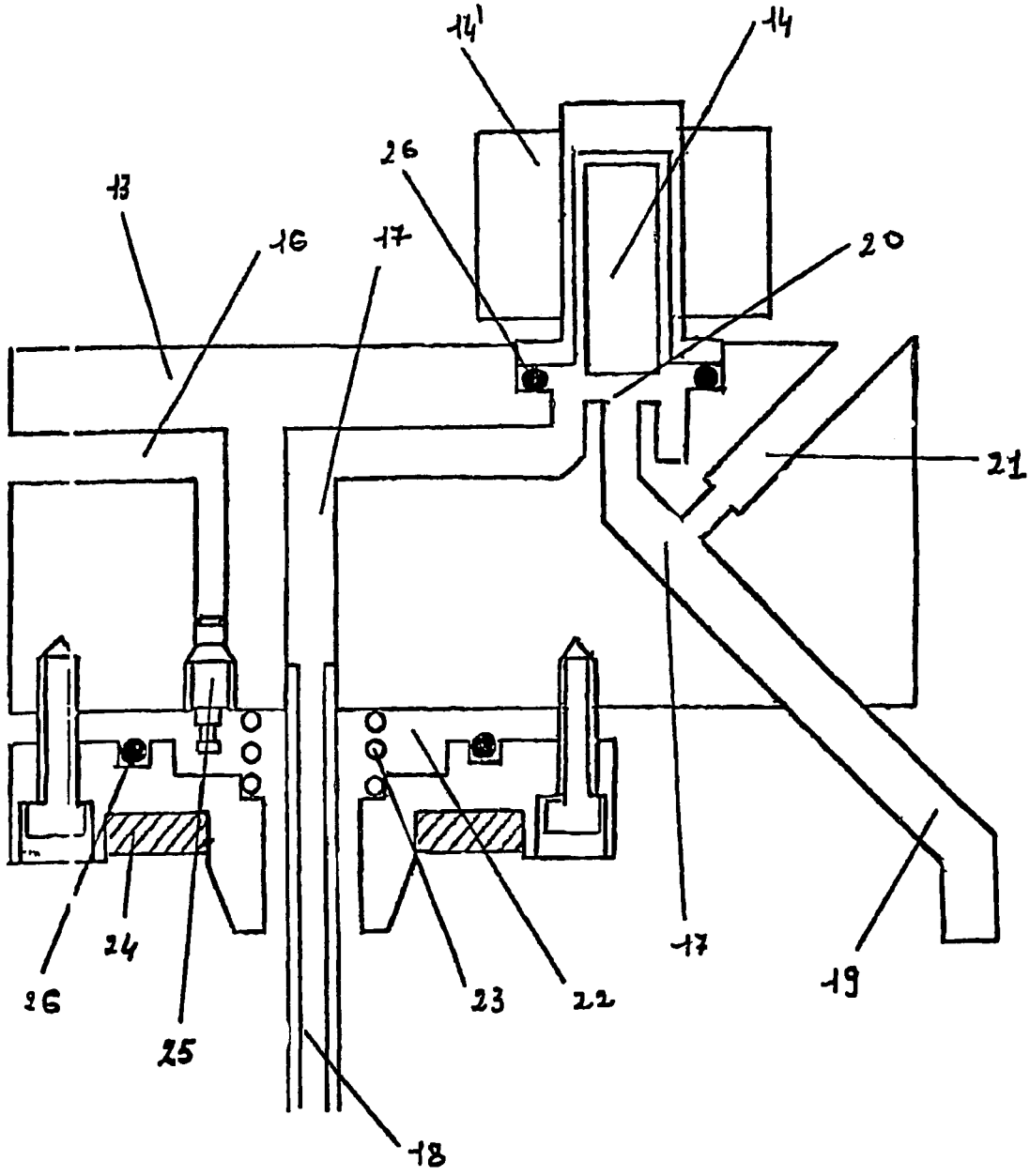
FIG. 3 shows a section of a particular embodiment of the drawing tap.

Acting on a suitable switch the gas is loaded into the bottle through the channel 16 bringing the liquid under the desired pressure. If the tap 15 is fitted with the needle valve (as illustrated in FIG. 3) the loading of the gas will take place automatically when the bottle neck pushes on the tap 15.

The apparatus is now ready for the drawing out of the liquid.

The user will switch on the apparatus, for example acting on a suitable switch or by introducing in the suitable inlet a magnetic or chip card (which can be personalised by a code number) and thereafter acting on the suitable switch 12' will open the corresponding electric valve. The gas under pressure contained in the bottle will push the liquid through the pipe 18, the channel 17 and the chamber 22, up to the spout 19 where it will be collected by the user.

Once the predetermined quantity of liquid has been drawn the electric valve will close and, after a short interval of time necessary to permit the flowing of the liquid remaining in channel 17 under the branch 21, a jet of gas is blown in through such branch 21, cleaning perfectly the drops of liquid remaining in the channel 17 and the spout 19.

The apparatus will be ready for a new draught.

Once the bottle is empty the lifting means 11 is lowered and the bottle is removed from the pipe 18 and a new bottle is installed. It is worth considering that during the substitution the pipe 18 hangs in the air and can not come into contact with possible sources of organic or inorganic pollutants.

Moreover it should also be noted that the whole operation can be performed by the operator with just one hand.

The apparatus according to the invention can obviously house more than one bottle each containing the same or different liquids (for example different vintages of the same wine), in this case the use of the software will make it easier for a quick debiting of the costs depending on the liquid drawn.

The invention claimed is:

1. Apparatus for the automatic drawing out of liquids from a bottle, by applying an inert gas to the liquid, wherein the bottle is kept in a vertical position, the apparatus comprising a housing body (10), lifting means (11) within said housing body, and a drawing tap (12), said drawing tap including:

a drawing tap body (14);

a first channel (16) connected to an inert gas circuit for receiving inert gas and for directing said gas into said bottle;

a second channel (17) for receiving said drawn liquid, said second channel having a first side and a second side;

a pipe (18) connected to said second channel at said first side for directing said drawn liquid from said bottle to said second channel;

a spout (19) connected to said second channel at said second side; a chamber (20) into which said second channel (17) enters;

an electric valve (14) having a piston for selectively closing said chamber; and a third channel (21) also connected to said inert gas circuit and connected to said second channel for receiving inert gas for cleaning at least said spout when said chamber is closed.

2. Apparatus according to claim 1 wherein the drawing tap (12) includes a tap element (15) having a conical mouth (15').

3. Apparatus of claim 2 wherein the tap element (15) is connected to the body (13) by a chamber (22).

4. Apparatus according to claim 3 wherein the tap element (15) is free to move up and down in the chamber (22).

5. Apparatus according to claim 4 wherein in the chamber (22) is present a spring (23) which pushes the tap element (15) downwards.

6. Apparatus according to claim 5 wherein the channel (16) has an end which enters into the chamber (22) and which is selectively closed at said end by a needle valve (25).

7. Apparatus of claim 1 wherein operation of said apparatus is controlled by software.

8. Apparatus of claim 1 wherein activation of the apparatus is performed by introducing a magnetic or chip card in a suitable inlet thereof.

9. Apparatus according to claim 1 wherein the housing body of the apparatus includes liquid crystal or luminous led-display showing the amount due for each draught.

10. Apparatus according to claim 1 wherein the body (10) houses more then one bottle.

11. Apparatus of claim 1 wherein said third channel (21) receives inert gas for further cleaning a portion of said second channel (17).

* * * * *